US005985090A

United States Patent [19]

Kikuta et al.

[11] Patent Number: 5,985,090

[45] Date of Patent: Nov. 16, 1999

[54] POLISHING CLOTH AND POLISHING APPARATUS HAVING SUCH POLISHING CLOTH

[75] Inventors: Ritsuo Kikuta, Ichikawa; Fujio Aoyama, Zama; Koji Kato, Fujisawa; Tamami Takahashi, Yamato, all of Japan

[73] Assignee: Ebara Corporation, Tokyo, Japan

[21] Appl. No.: 08/650,144

[22] Filed: May 17, 1996

[30] Foreign Application Priority Data

May 17, 1995 [JP] Japan ..... 7-142499

[51] Int. Cl.[6] ..... C23F 1/02; B44C 1/22

[52] U.S. Cl. ..... 156/345; 216/88; 438/692

[58] Field of Search ..... 156/345; 216/88, 216/89; 438/692, 693

[56] References Cited

U.S. PATENT DOCUMENTS

| | | | |
|---|---|---|---|
| 5,578,362 | 11/1996 | Reinhardt et al. | 428/147 |
| 5,609,517 | 3/1997 | Lofaro | 451/529 |
| 5,769,699 | 6/1998 | Yu | 451/528 |
| 5,888,126 | 3/1999 | Hirose et al. | 451/287 |

FOREIGN PATENT DOCUMENTS

| | | |
|---|---|---|
| 607441 | 7/1994 | European Pat. Off. . |
| 61-100358 | 5/1986 | Japan . |
| 6-333891 | 12/1994 | Japan . |

*Primary Examiner*—William Powell
*Assistant Examiner*—George Goudreau
*Attorney, Agent, or Firm*—Wenderoth, Lind & Ponack, L.L.P.

[57] ABSTRACT

A polishing cloth mounted on a turntable of a polishing apparatus and a polishing apparatus having such a polishing cloth for polishing a workpiece such as a semiconductor wafer to a flat mirror finish. The polishing cloth comprises a first elastic region contacting the surface of the workpiece and having a certain elastic modulus, and a second elastic region contacting the surface of the workpiece and having an elastic modulus different from the first elastic region. The second elastic region is surrounded by the first elastic region and has a smaller dimension in a radial direction of the turntable than a diameter of the workpiece when the second elastic region is held in contact with the workpiece. The position of the second elastic region is determined on the basis of an area in which the second elastic region acts on the workpiece.

16 Claims, 17 Drawing Sheets

POLISHING CLOTH AND POLISHING APPARATUS HAVING SUCH POLISHING CLOTH

BACKGROUND OF THE INVENTION

1. Field of the Invention

The present invention relates to a polishing cloth and a polishing apparatus having such a polishing cloth, and more particularly to a polishing cloth mounted on a turntable of a polishing apparatus and a polishing apparatus having such a polishing cloth for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. During operation, the top ring exerts a certain pressure on the turntable, and the surface of the semiconductor wafer held against the polishing cloth is therefore polished to a flat mirror finish while the top ring and the turntable are rotating.

The polishing apparatus is required to have such performance that the surfaces of semiconductor wafers have a highly accurate flatness. Therefore, it is preferable that the lower end surface of the top ring which holds a semiconductor wafer and the contact surface of the polishing cloth which is held in contact with the semiconductor wafer, and hence the surface of the turntable to which the polishing cloth is attached, have a highly accurate flatness, and those surfaces which are highly accurately flat have been used in the art.

It is known that the polishing action of the polishing apparatus is affected not only by the configurations of the holding surface of the top ring and the contact surface of the polishing cloth, but also by the relative speed between the polishing cloth and the semiconductor wafer, the distribution of pressure applied to the surface of the semiconductor wafer which is being polished, the amount of the abrasive liquid on the polishing cloth, and the period of time when the polishing cloth has been used. It is considered that the surface of the semiconductor wafer can be highly accurately flat if the above factors which affect the polishing action of the polishing apparatus are equalized over the entire surface of the semiconductor wafer to be polished.

However, some of the above factors can easily be equalized over the entire surface of the semiconductor wafer, but other factors cannot be equalized. For example, the relative speed between the polishing cloth and the semiconductor wafer can easily be equalized by rotating the turntable and the top ring at the same rotational speed and in the same direction. However, it is difficult to equalize the amount of the abrasive liquid on the polishing cloth because of centrifugal forces imposed on the abrasive liquid.

The above approach which tries to equalize all the factors affecting the polishing action, including the flatnesses of the lower end surface of the top ring and the upper surface of the polishing cloth on the turntable, over the entire surface of the semiconductor wafer to be polished poses limitations on efforts to make the polished surface of the semiconductor wafer flat, often resulting in a failure to accomplish a desired degree of flatness of the polished surface.

It has been customary to achieve a more accurate flatness by making the holding surface of the top ring concave or convex to develop a certain distribution of pressure on the surface of the semiconductor wafer for thereby correcting irregularities of the polishing action which are caused by an irregular entry of the abrasive liquid and variations in the period of time when the polishing cloth has been used. It has also been practiced to correct irregularities of the polishing action by using a top ring which has a diaphragm and changing a distribution of pressure applied by the top ring while the semiconductor wafer is being polished.

However, various problems have arisen in the case where a specific configuration is applied to the holding surface of the top ring. Specifically, since the holding surface of the top ring is held in contact with the semiconductor wafer at all times, the holding surface of the top ring affects the polishing action continuously all the time while the semiconductor wafer is being polished. Because the configuration of the holding surface of the top ring has direct effect on the polishing action, it is highly complex to correct irregularities of the polishing action by intentionally making the holding surface of the top ring concave or convex, i.e., non-flat. If the holding surface of the top ring which has been made intentionally concave or convex is inadequate, the polished surface of the semiconductor wafer may not be made as flat as desired, or irregularities of the polishing action may not be sufficiently corrected, so that the polished surface of the semiconductor wafer may not be sufficiently flat.

In addition, inasmuch as the holding surface of the top ring is of substantially the same size as the surface of the semiconductor wafer to be polished, the holding surface of the top ring is required to be made irregular in a very small area. Because such surface processing is highly complex, it is not easy to correct irregularities of the polishing action by means of the configuration of the holding surface of the top ring.

The conventional polishing apparatuses, particularly those for polishing semiconductor wafers, are required to polish workpiece surfaces to higher flatness. There have not been available suitable means and apparatus for polishing workpieces to shapes which are intentionally not flat or for polishing workpieces such that desired localized areas of workpiece surfaces are polished to different degrees.

SUMMARY OF THE INVENTION

It is therefore an object of the present invention to provide a polishing cloth which can easily correct irregularities of a polishing action on a workpiece such as a semiconductor wafer, and polish a workpiece with a more intensive polishing action or a less intensive polishing action on a desired localized area thereof.

Also, it is another object of the present invention to provide a polishing apparatus, having the above polishing cloth, which can polish a workpiece such as a semiconductor wafer to a flat mirror finish.

According to a polishing cloth of a first aspect of the present invention, there is provided a polishing cloth mounted on a turntable for contacting and polishing a surface of a workpiece supported by a top ring, the polishing cloth comprising: a first elastic region contacting the surface of the workpiece and having a certain elastic modulus; and a second elastic region contacting the surface of the workpiece and having an elastic modulus different from the first elastic region, the second elastic region being surrounded by the first elastic region and having a smaller dimension in a radial direction of the turntable than a diameter of the workpiece when the second elastic region is held in contact with the workpiece, and a position of the second elastic region being determined on the basis of an area in which the second elastic region acts on the workpiece.

According to the first aspect of the present invention, while the workpiece is being polished, the workpiece intermittently passes over the second elastic region having the elastic modulus different from that of the first elastic region of the polishing cloth which is held in contact with the workpiece. Thus, a certain area of the workpiece is contacted by the second elastic region, and other areas are contacted by the first elastic region of the polishing cloth. Since the second elastic region produces a different polishing action from that of the first elastic region of the polishing cloth, the area of the workpiece that is contacted by the second elastic region is polished to a different degree from the other areas contacted by the first elastic region of the polishing cloth. By determining the position of the second elastic region in consideration of the area in which the second elastic region acts on the workpiece, it is possible to polish a desired area of the workpiece more intensively or less intensively. That is, the area of the workpiece which contacts the second elastic region having high elastic modulus is polished more intensively, and the area of the workpiece which contacts the second elastic region having low elastic modulus is polished less intensively.

Determining the position of the second elastic region in consideration of the area in which the second elastic region acts on the workpiece means that the size and position of the second elastic region are selected in consideration of a polished surface produced by the shape, size, position, and height of the second elastic region or regions if plural second elastic regions are employed. In the case where plural second elastic regions are employed, even if each of the second elastic regions is of a simple shape such as a circular shape, the number and positions of the second elastic regions may be suitably selected in a relatively wide region of the polishing cloth, thus making it possible to control a distribution of the polishing rate of the workpiece. Therefore, a desired polished surface of the workpiece can be obtained.

If the workpiece is a semiconductor wafer, for example, which is to be polished flatwise, the position of the second elastic region is determined so as to intensively polish an area where the polishing rate would otherwise be too small, thereby correcting polishing irregularities. In this manner, the workpiece can be polished to a desired flatness.

According to a polishing cloth of a second aspect of the present invention, there is provided a polishing cloth mounted on a turntable for contacting and polishing a surface of a workpiece supported by a top ring, the polishing cloth comprising: a substrate contacting the surface of the workpiece and having a certain elastic modulus; and a recess defined in a lower surface of the substrate and having a smaller dimension in a radial direction of the turntable than a diameter of the workpiece, and a position of the recess being determined on the basis of an area in which the recess acts on the workpiece.

According to the second aspect of the present invention, while the workpiece is being polished, the workpiece intermittently passes over a region corresponding to the recess defined in the lower surface of the polishing cloth. Since the polishing cloth over the recess is depressed under the pressure of the workpiece, the polishing cloth over the recess produces a weaker polishing action than the flat portion of the polishing cloth. Therefore, the area of the workpiece that is contacted by the flat portion of the polishing cloth is polished to a greater degree than the portion of the polishing cloth over the recess. By determining the position of the recess in consideration of the area in which the recess acts on the workpiece, it is possible to polish a desired area of the workpiece more intensively or less intensively.

In the case where plural recesses are employed, they may be combined in the same manner as the second elastic regions described above, thus making it possible to obtain a desired polished surface of the workpiece. If the workpiece is a semiconductor wafer, for example, which is to be polished flatwise, then the position of the recess is determined so as to less intensively polish an area where the polishing rate would otherwise be too large, thus correcting polishing irregularities. Therefore, the workpiece can be polished to a desired flatness.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
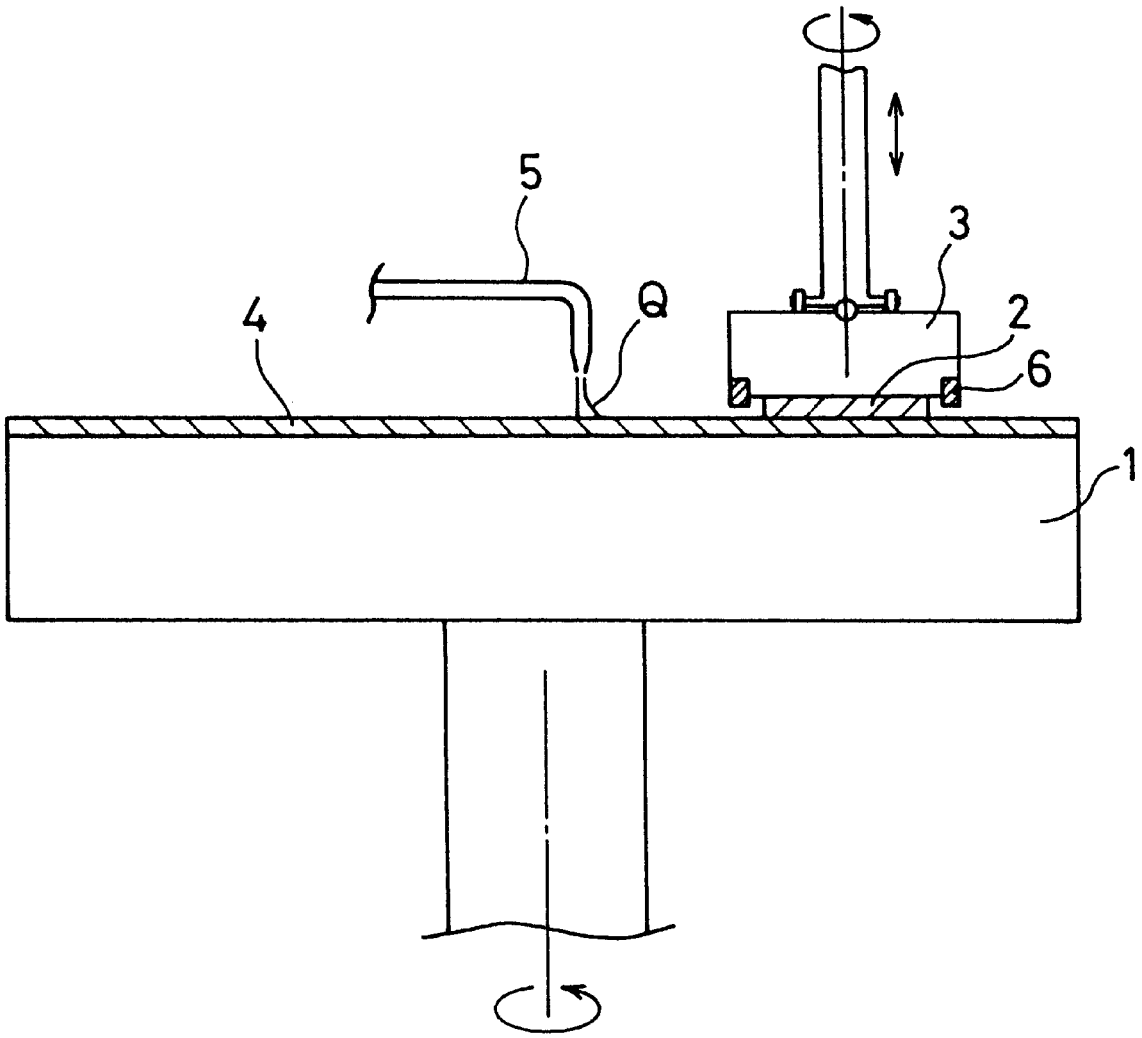
FIG. 1 is a vertical cross-sectional view of a polishing apparatus having a polishing cloth according to an embodiment of the present invention.

As shown in FIG. 1, a polishing apparatus according to an embodiment of the present invention has a turntable 1 and a top ring 3 positioned above the turntable 1 for holding a semiconductor wafer 2 and pressing the semiconductor wafer 2 against the turntable 1. The turntable 1 is rotatable about its own axis as indicated by the arrow by a motor (not shown) which is coupled through a shaft to the turntable 1. A polishing cloth 4 is attached to an upper surface of the turntable 1.

The top ring 3 is coupled to a motor (not shown) and also to an air cylinder (not shown). The top ring 3 is vertically movable and rotatable about its own axis as indicated by the arrows by the motor and the air cylinder. The top ring 3 can therefore press the semiconductor wafer 2 against the polishing cloth 4 under a desired pressure. A guide ring 6 is mounted on the outer circumferential edge of the lower surface of the top ring 3 for preventing the semiconductor wafer 2 from being disengaged from the top ring 3.

An abrasive liquid supply nozzle 5 is disposed directly above the turntable 1 for supplying an abrasive liquid Q containing an abrasive material onto the polishing cloth 4 mounted on the turntable 1.

The polishing apparatus operates as follows: The semiconductor wafer 2 is held on the lower surface of the top ring 3, and pressed against the polishing cloth 4 on the upper surface of the turntable 1 which is being rotated, by the air cylinder. The abrasive liquid supply nozzle 5 supplies the abrasive liquid Q onto the polishing cloth 4, and the supplied abrasive liquid Q is retained on the polishing cloth 4. The lower surface of the semiconductor wafer 2 is polished in such a state that the abrasive liquid Q is present between the lower surface of the semiconductor wafer 2 and the polishing cloth 4.

Figure 2A:
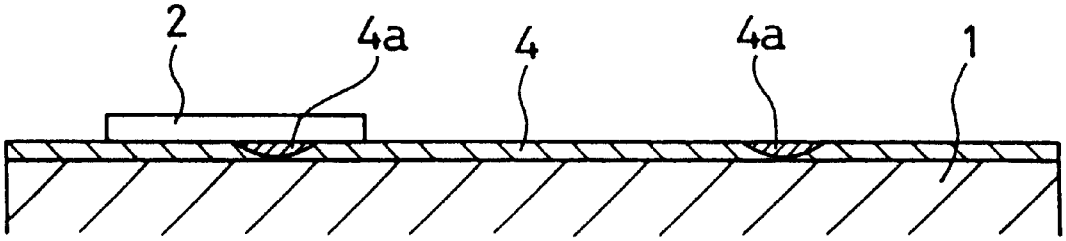
FIG. 2A is an enlarged cross-sectional view of a turntable and the polishing cloth of the polishing apparatus.
Figure 2B:
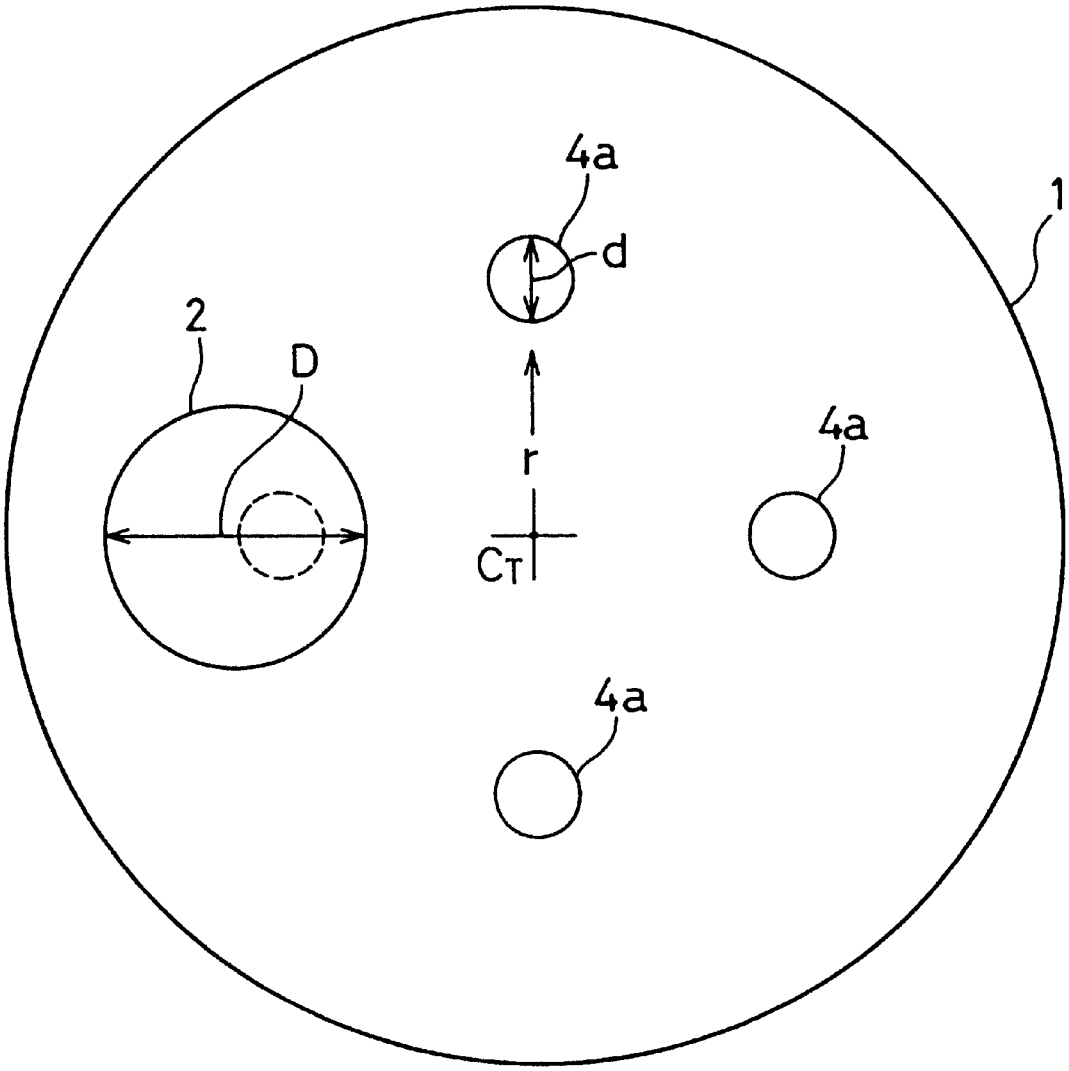
FIG. 2B is a plan view of the polishing cloth of the polishing apparatus.

FIGS. 2A and 2B show the turntable 1 and the polishing cloth 4 in detail. As shown in FIG. 2A, the polishing cloth 4 has circular regions 4*a* which are held in contact with the semiconductor wafer 2. The circular regions 4*a* have an elastic modulus different from that of the other region which surrounds the circular regions 4*a*. Hereinafter, the circular region 4*a* is referred to as second elastic region 4*a*, and the other region which surrounds the second elastic region 4*a* is referred to as first elastic region. The upper surface of the second elastic region 4*a* and the upper surface of the first elastic region are on the same plane. The second elastic regions 4*a* are formed by a thermosetting process. While each of the second elastic regions 4*a* is being held in contact with the semiconductor wafer 2, the length "d" of each second elastic region 4*a* in the radial direction (of the turntable) indicated by the arrow "r" (see FIG. 2B) across the turntable 1 is smaller than the diameter "D" of the semiconductor wafer 2, and the position of each second elastic region 4*a* is determined based on an area in which the second elastic region 4*a* acts on the semiconductor wafer 2.

The polishing cloth 4 generally comprises fibers impregnated with urethane resin or polyurethane foam. Typically, the polishing cloth 4 may be made of SUBA (trade name) or IC-1000 (trade name) manufactured by Rodel Products Corporation.

The second elastic regions 4*a* of the polishing cloth 4 serve to correct the polishing rate of the semiconductor wafer 2. The second elastic regions 4*a* offer the following advantages: The second elastic regions 4*a* act on the semiconductor wafer 2 only during the period of time when they pass over the surface of the semiconductor wafer 2, rather than during the entire period of time when the semiconductor wafer 2 is polished by the top ring 3 and the polishing cloth 4. Specifically, the second elastic regions 4*a* act for a shorter period of time than the top ring 3 which is held in contact with the semiconductor wafer 2 at all times. Thus, the difference in the polishing rate (the thickness of the semiconductor wafer to be polished per unit time) between the second elastic region 4*a* and the first elastic region surrounding the second elastic region 4*a* is on the order of several hundred angstroms/min. This means that the polished surface of the semiconductor wafer can be controlled by providing the second elastic region 4*a*.

The polishing action of the elastic regions 4*a*, of the polishing cloth 4, which is held in contact with the semiconductor wafer 2, will be described below with reference to FIGS. 3A and 3B through 10A and 10B.

Figure 3A:
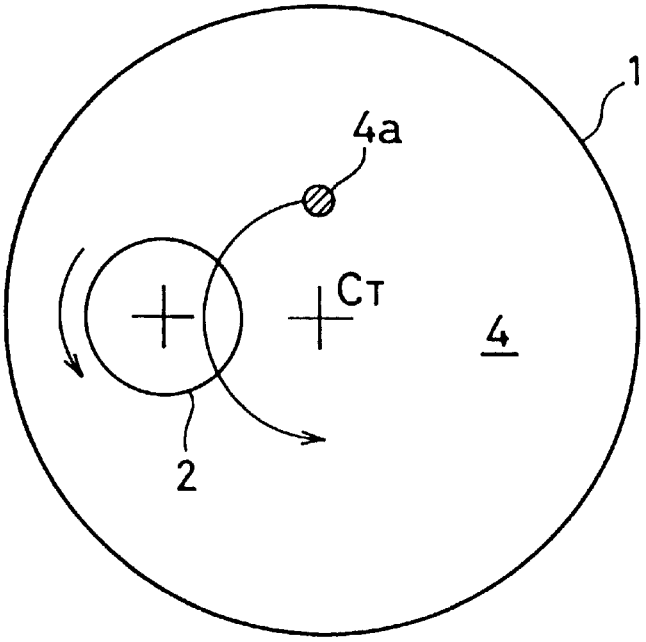
FIGS. 3A and 3B are plan views showing the manner in which the polishing cloth operates, with a single circular elastic region (second elastic region) having an elastic modulus different from the other region (first elastic region) of the polishing cloth.
Figure 3B:
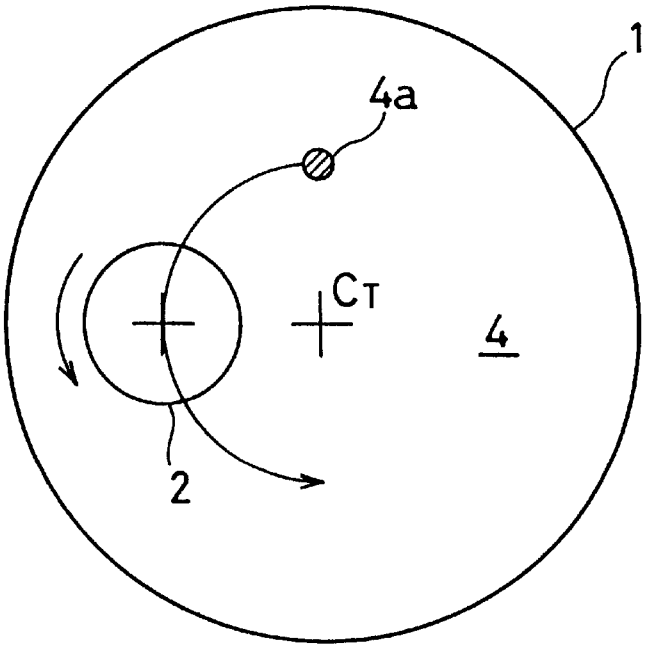

FIGS. 3A and 3B are plan views of the polishing cloth 4, showing a single circular elastic region (second elastic region) 4*a* of the polishing cloth 4 which is held in contact with the semiconductor wafer 2. In FIG. 3A, the second elastic region 4*a* is positioned so as to pass through only a certain inside area of the semiconductor wafer 2. In FIG. 3B, the second elastic region 4*a* is positioned so as to pass through a central area of the semiconductor wafer 2. It is assumed that the turntable 1 and the semiconductor wafer 2 are rotated at the same angular velocity and in the same direction.

Figure 4A:
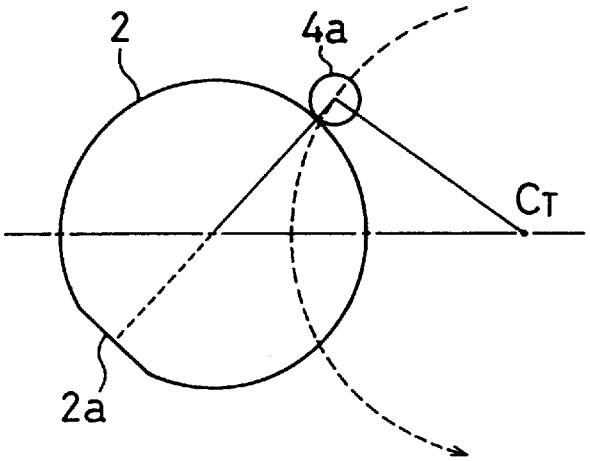
FIGS. 4A through 4D are plan views showing the manner in which the second elastic region shown in FIG. 3A operates.

The path of the second elastic region 4*a* within the inside area of the semiconductor wafer 2 as shown in FIG. 3A will be described below with reference to FIGS. 4A through 4D. FIG. 4A shows the instant when the second elastic region 4*a* contacts an outer circumferential edge of the semiconductor wafer 2 while the second elastic region 4*a* rotates about the center $C_T$ of the turntable 1. At this time, an orientation flat 2*a* formed on the outer periphery of the semiconductor wafer 2 is positioned in diametrically opposite relation to the second elastic region 4*a*.

Figure 4B:
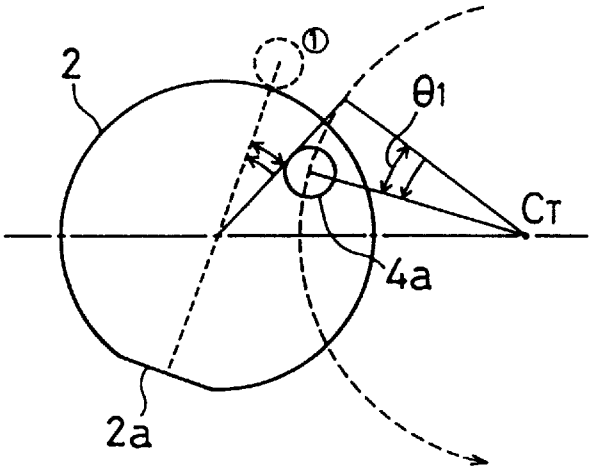

When the turntable 1 rotates through an angle $\theta_1$ from the position shown in FIG. 4A, the second elastic region 4*a* is positioned in its entirety within the inside area of the semiconductor wafer 2 as shown in FIG. 4B. Since the turntable 1 and the semiconductor wafer 2 are rotated at the same angular velocity and in the same direction, the semiconductor wafer 2 also rotates through the angle $\theta_1$. Therefore, when the semiconductor wafer 2 is in the position shown in FIG. 4B, the position in which the second elastic region 4*a* was held in contact with the semiconductor wafer 2 as shown in FIG. 4A is indicated by a broken-line circle ① in FIG. 4B.

Figure 4C:
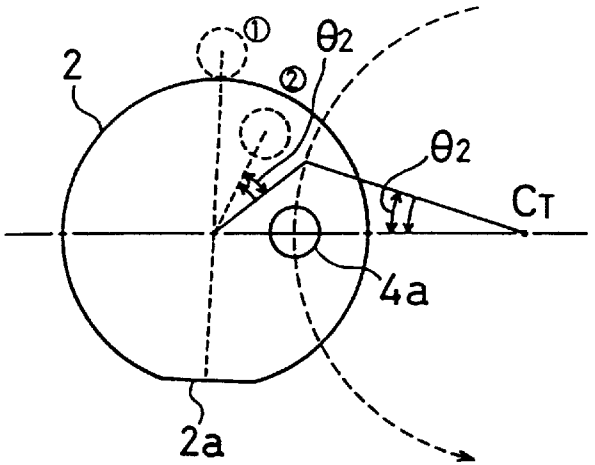

When the turntable 1 further rotates through an angle $\theta_2$ from the position shown in FIG. 4B to the position shown in FIG. 4C, the semiconductor wafer 2 also rotates through the angle $\theta_2$. Therefore, when the semiconductor wafer 2 is in the position shown in FIG. 4C, the positions in which the second elastic region 4*a* was held in contact with the semiconductor wafer 2 as shown in FIGS. 4A and 4B are indicated respectively by broken-line circles ①, ② in FIG. 4C. The position in which the second elastic region 4*a* was held in contact with the semiconductor wafer 2 as shown in FIG. 4A is diametrically opposite to the orientation flat 2*a* of the semiconductor wafer 2 at all times.

Figure 4D:
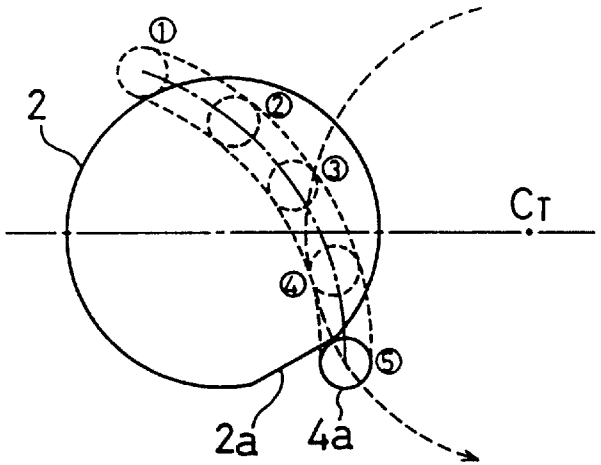
Figure 5:
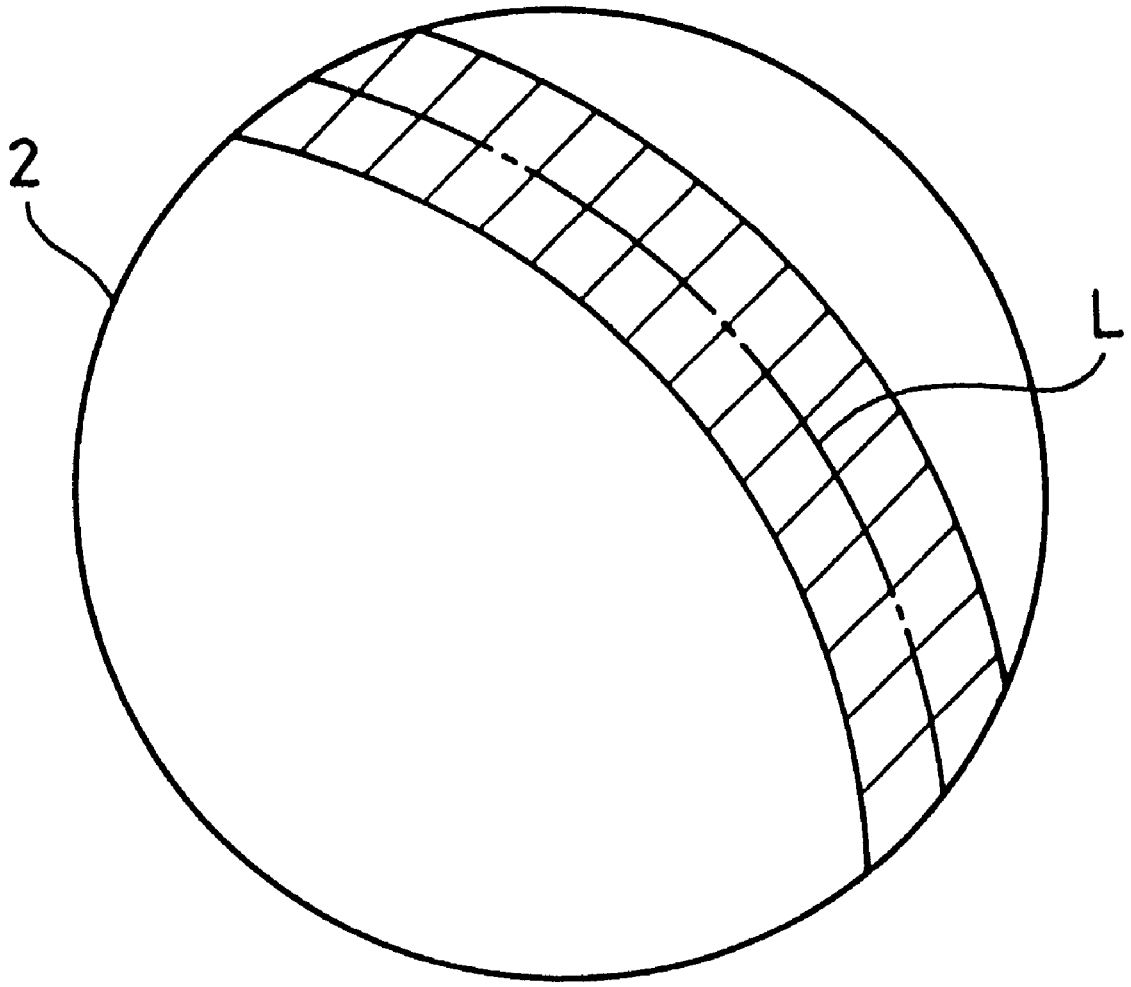
FIG. 5 is a plan view showing an area contacted by the second elastic region shown in FIG. 3A.

Because the turntable 1 and the semiconductor wafer 2 rotate in this manner, the second elastic region 4*a* passes over the surface of the semiconductor wafer 2 through a path indicated by ①, ②, ③, ④, ⑤ in FIG. 4D. Accordingly, the second elastic region 4*a* contacts an area of the lower surface of the semiconductor wafer 2 which is hatched in FIG. 5. In FIG. 5, the center of the second elastic region 4*a* which is of a circular shape follows a dot-and-dash-line path L extending in and along the hatched area.

Figure 6:
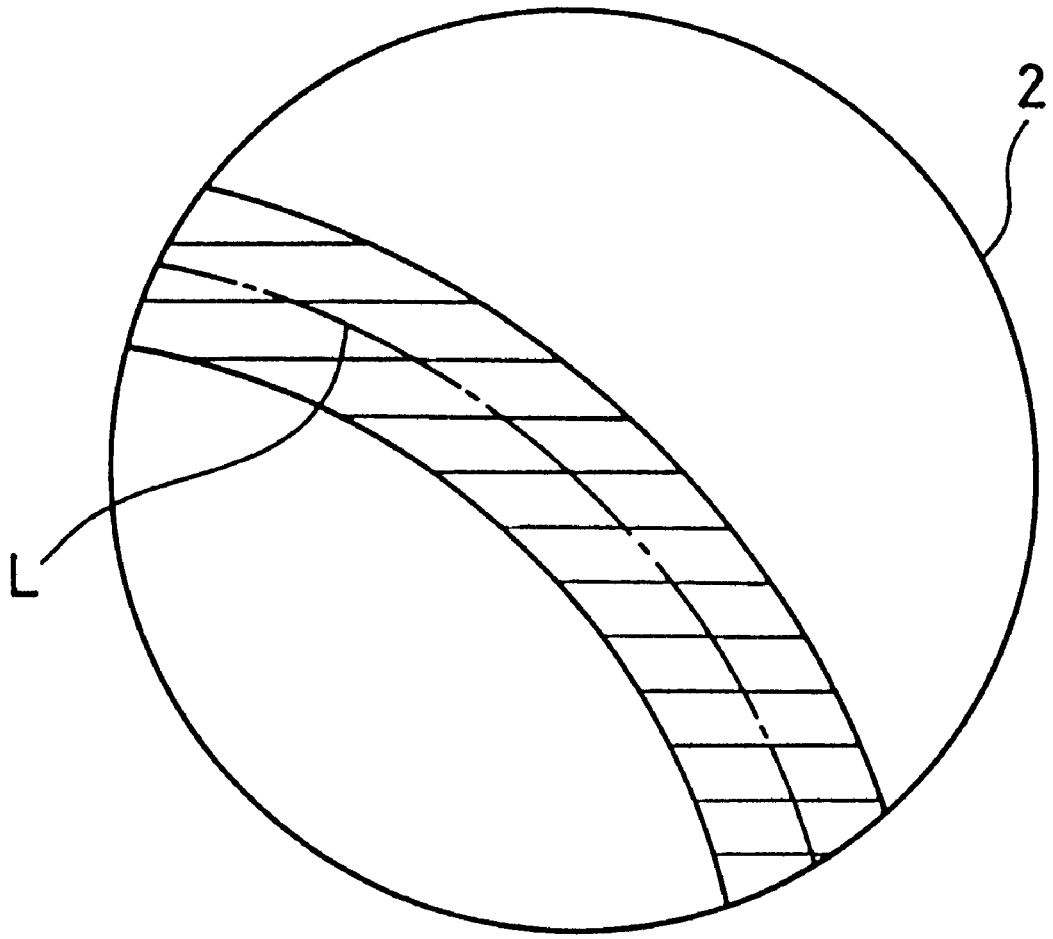
FIG. 6 is a plan view showing an area contacted by the second elastic region shown in FIG. 3B.

In the case where the second elastic region 4*a* is positioned so as to pass through a central area of the semiconductor wafer 2, as shown in FIG. 3B, the locus of the second elastic region 4*a* is shown in FIG. 6.

Figure 7:
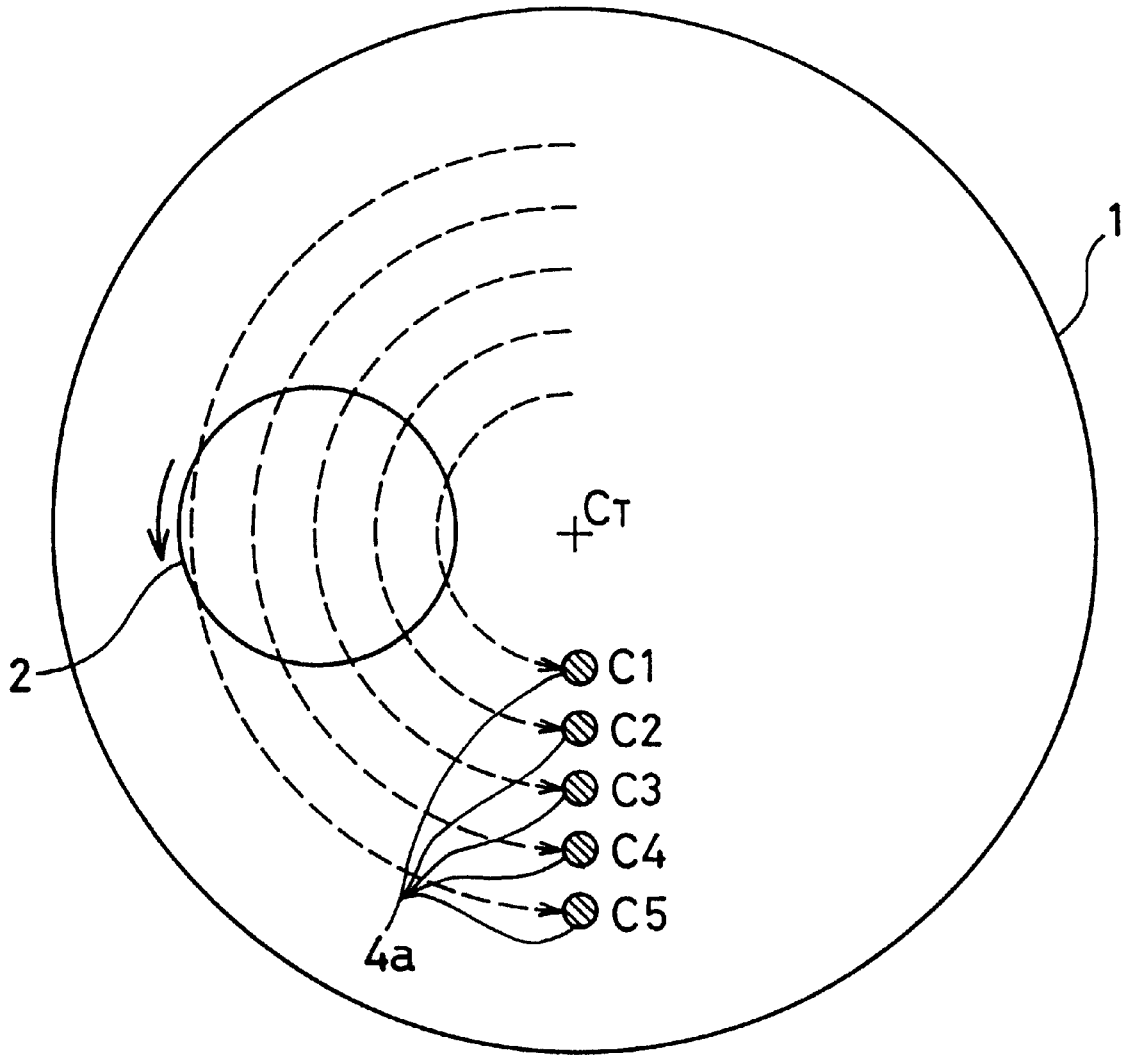
FIG. 7 is a plan view showing the manner in which the polishing cloth operates, the view illustrating how a single second elastic region may be positioned in different locations on the polishing cloth.
Figure 8:
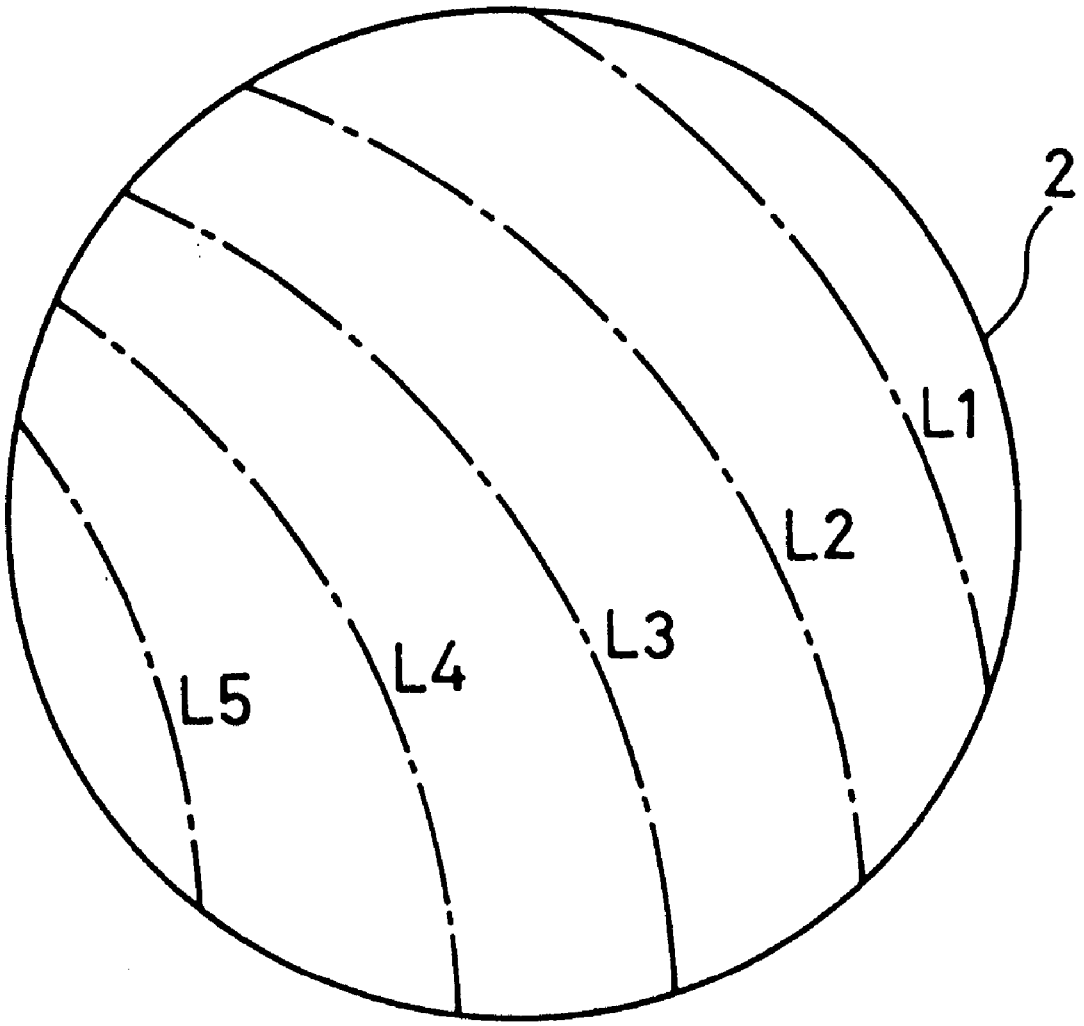
FIG. 8 is a plan view showing the paths of centers of areas in which the second elastic region in each position affects the surface of a semiconductor wafer to be polished in the embodiment of FIG. 7.
Figure 9:
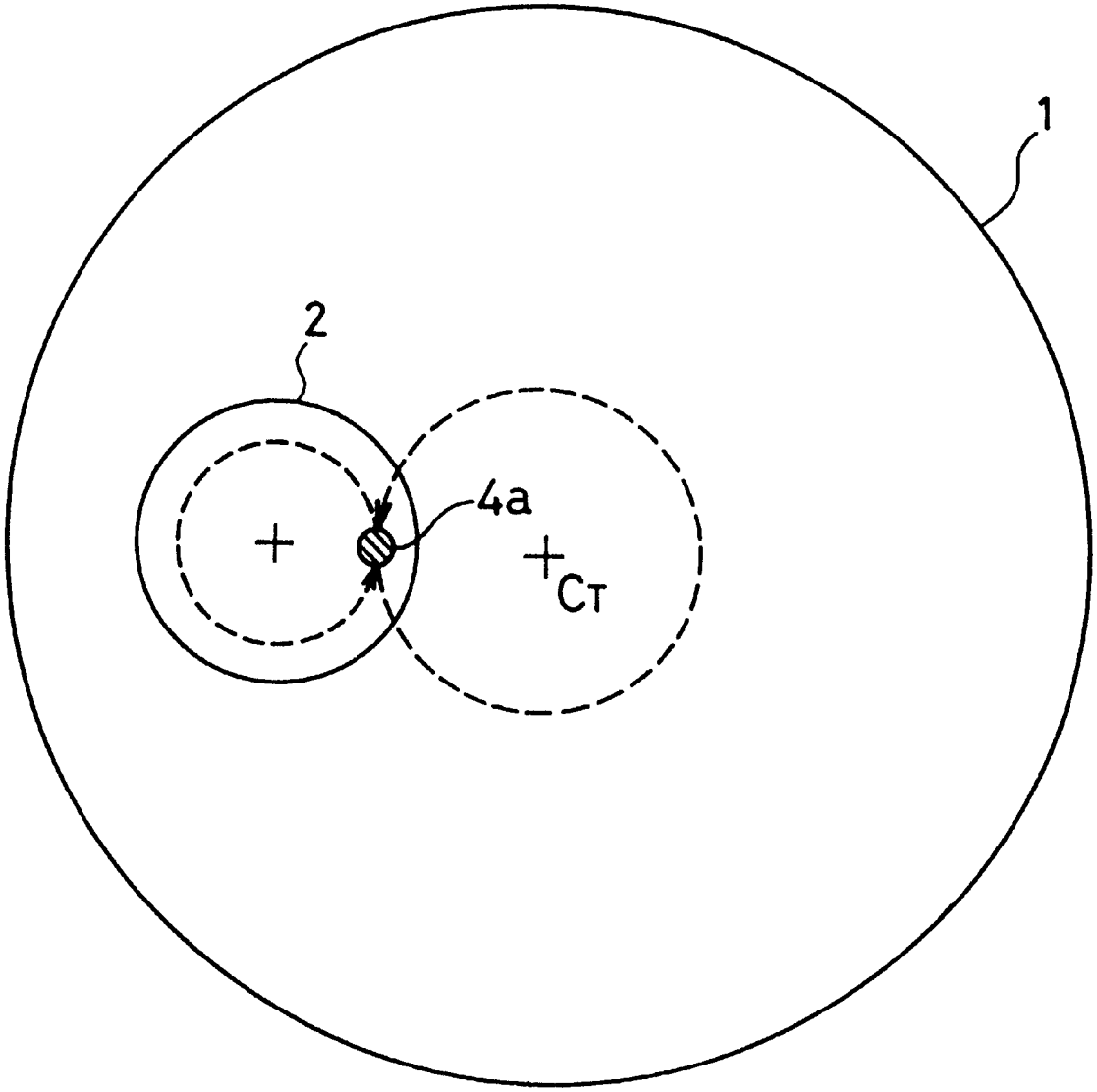
FIG. 9 is a plan view showing a polishing action of the polishing cloth.

Therefore, the second elastic region 4*a* passes through different surface areas of the semiconductor wafer 2 in accordance with the position of the second elastic region 4*a* of the polishing cloth 4. FIG. 7 shows how the second elastic region 4*a* may be positioned in other locations of the polishing cloth 4, in addition to the locations of the second elastic region 4*a* shown in FIGS. 3A and 3B. In FIG. 7, the second elastic region 4*a* is positioned in each of locations C1, C2, C3, C4, C5 radially spaced at successive distances from the center $C_T$ of the turntable 1. As shown in FIG. 8, the second elastic region 4*a* positioned in each of locations C1, C2, C3, C4, C5 has its loci L1, L2, L3, L4, L5, respectively, within the lower surface of the semiconductor wafer 2 when the turntable 1 and the semiconductor wafer 2 rotate in unison with each other. The loci L1, L2, L3, L4, L5 shown in FIG. 8 are viewed from the reverse side of the semiconductor wafer 2, i.e., the upper surface of the semiconductor wafer 2 which is opposite to the surface thereof which is being polished.

In the case where the single second elastic region 4*a* is employed as shown in FIGS. 3A and 3B through 8, if the turntable 1 and the semiconductor wafer 2 are rotated at the same rotational speed to uniformize the relative speed between the turntable 1 and the semiconductor wafer 2 on the surface of the semiconductor wafer 2 to be polished, then the second elastic region 4*a* passes through the same position on the semiconductor wafer 2 at all times. Specifically, when the turntable 1 makes one revolution from the position shown in FIG. 9, since the semiconductor wafer 2 also makes one revolution, the second elastic region 4*a* rotates from the illustrated position and back again to the illustrated position. Since the second elastic region 4*a* passes through the same position on the semiconductor wafer 2 at all times, only a certain localized area of the semiconductor wafer 2 tends to be excessively polished by the second elastic region 4*a*. Such a shortcoming can be avoided by rotating the turntable 1 and the semiconductor wafer 2 at different rotational speeds while polishing the semiconductor wafer 2. When the turntable 1 and the semiconductor wafer 2 are rotated at different rotational speeds, the second elastic region 4*a* acts on a different area on the semiconductor wafer 2 each time when the turntable 1 makes one revolution. Accordingly, the semiconductor wafer 2 is prevented from being polished only in a localized area thereof.

The paths of the second elastic region 4*a* which are illustrated above are based on the rotation of the turntable 1 and the top ring 3 at the same rotational speed. The second elastic region 4*a* moves along different paths when the turntable 1 and the semiconductor wafer 2 are rotated at different rotational speeds. However, if the difference between the rotational speeds of the turntable 1 and the semiconductor wafer 2 is not significantly large, then the paths of the second elastic region 4*a* remain substantially the same.

Figure 10A:
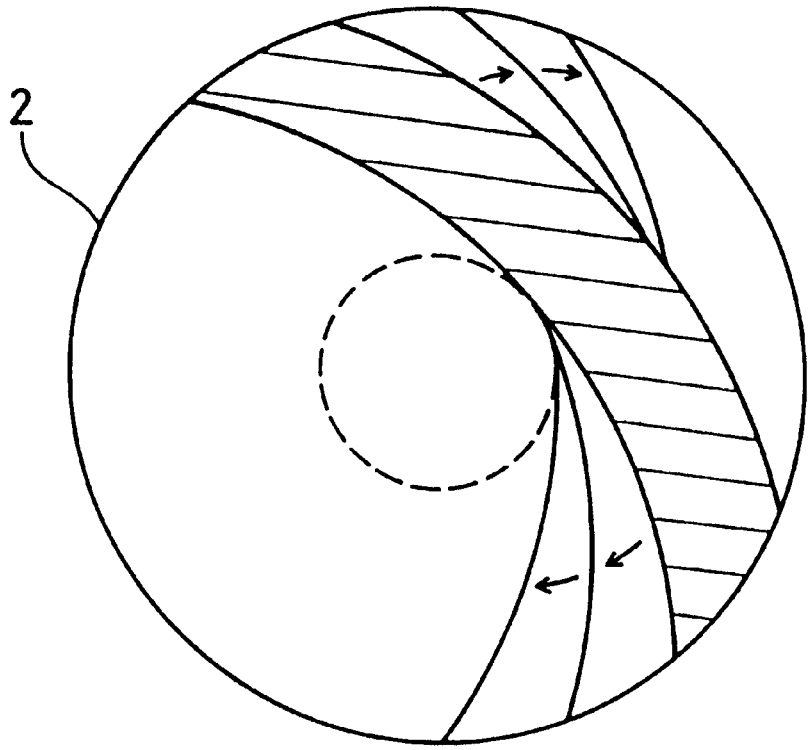
FIGS. 10A and 10B are other views showing a polishing action of the polishing cloth.

When the turntable 1 and the semiconductor wafer 2 are rotated at different rotational speeds, the second elastic region 4*a* passes along a different path on the semiconductor wafer 2 each time when the turntable 1 makes one revolution, until it contacts the entire surface of the semiconductor wafer 2, as shown in FIG. 10A. In FIG. 10A, the second elastic region 4*a* contacts the semiconductor wafer 2 in a hatched area which is progressively moved as indicated by the arrows, until the second elastic region 4*a* contacts an entire area outside the circle indicated by the broken line.

Figure 10B:
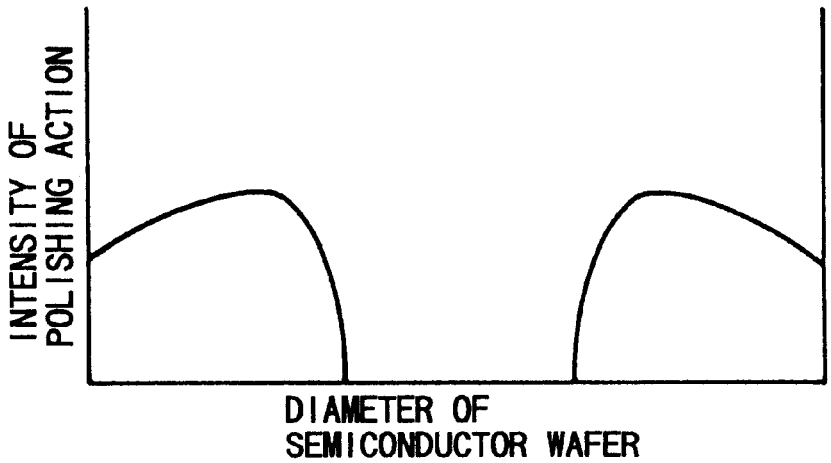

In an area of the semiconductor wafer 2 which is polished by the second elastic region 4*a*, the center of the second elastic region 4*a* which is of a circular shape acts on the semiconductor wafer 2 over a longer distance. Therefore, the second elastic region 4*a* acts more intensively on some regions and less intensively on the other regions within the area of the semiconductor wafer 2 which is polished by the second elastic region 4*a*. Such different degrees of the polishing action of the second elastic region 4*a* are illustrated in FIG. 10B.

The area of the semiconductor wafer 2 which is polished by the second elastic region 4*a* is of a concentric annular shape on the surface of the semiconductor wafer 2. The profile of the degree (referred to as intensity of polishing action) to which the second elastic region 4*a* acts on, i.e., polishes the surface of the semiconductor wafer 2, is determined by the proportion of the period of time during which the second elastic region 4*a* passes over the surface of the semiconductor wafer 2.

Even when the turntable 1 and the semiconductor wafer 2 are rotated at the same rotational speed, the top ring 3 may have such structure to impart a planetary motion to the semiconductor wafer 2 for thereby rotating the semiconductor wafer 2 at a rotational speed different from the rotational speed of the top ring 3, as disclosed in Japanese patent application No. 5-321260 (corresponding to U.S. Pat. No. 5,398,459). Such an arrangement is also effective in preventing the semiconductor wafer 2 from being polished only in a localized area thereof.

While use of only the single second elastic region 4*a* has been described above, a plurality of second elastic regions may be used to produce a more intensive polishing action on the semiconductor wafer 2. The number of second elastic regions used may be selected depending on the degree or extent to which the semiconductor wafer 2 is to be polished.

The size of the second elastic regions as well as the number of second elastic regions is also one of the factors that affect the polishing action on the semiconductor wafer 2. Therefore, in a selected local area or the entire area of the semiconductor wafer, the polishing rate of the semiconductor wafer 2 can precisely be controlled by selecting the position, number, and size of second elastic regions. Selection of the position, number, and size of second elastic regions for an optimum combination may automatically be carried out by a computer or the like.

Figure 11A:
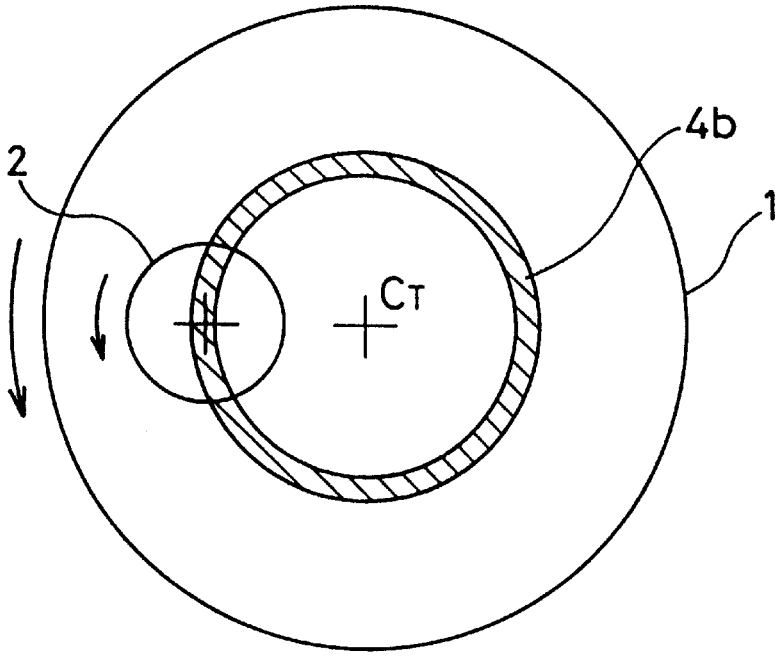
FIGS. 11A and 11B are plan views showing the manner in which the polishing cloth operates, with a single annular elastic region (second elastic region) having an elastic modulus different from the other region (first elastic region) of the polishing cloth.
Figure 11B:
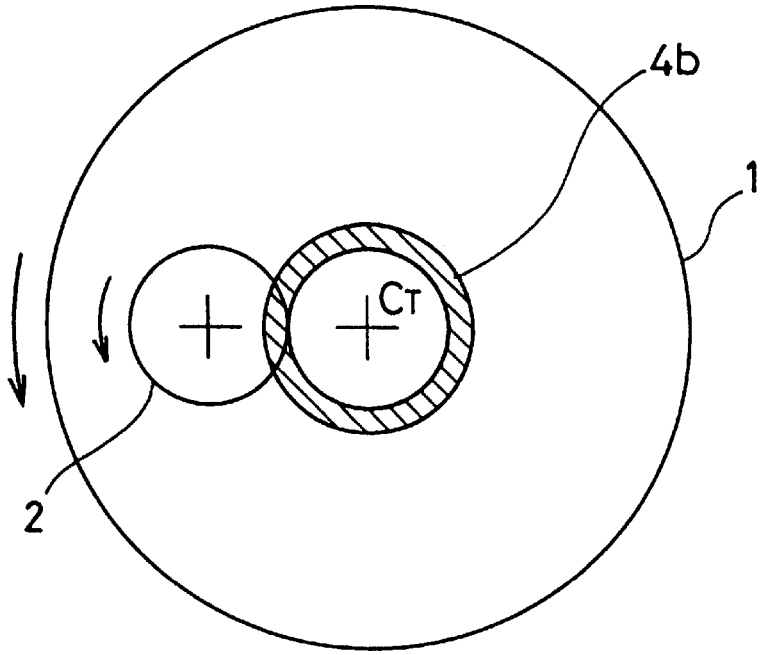

Annular regions 4*b* of different sizes on the polishing cloth 4 will be described below with reference to FIGS. 11A, 11B and 12A, 12B. The annular regions 4*b* have an elastic modulus different from that of the other region which surrounds the annular regions 4*b*. Hereinafter, the annular region 4*b* is referred to as second elastic region 4*b*, and the other region which surrounds the second elastic region 4*b* is referred to as first elastic region. The upper surface of the second elastic region 4*b* and the upper surface of the first region 4*b* are on the same plane. FIG. 11A shows an annular second elastic region 4*b* positioned concentrically with the center $C_T$ of the turntable 1, the second elastic region 4*b* being positioned so as to extend through the center of the semiconductor wafer 2. FIG. 11B shows a second elastic region 4*b* positioned concentrically with the center $C_T$ of the turntable 1, the second elastic region 4*b* being positioned so as to extend through an outer circumferential edge portion of the semiconductor wafer 2. In each of FIGS. 11A and 11B, the second elastic region 4*b* is held in contact with the semiconductor wafer 2 at all times.

Figure 12A:
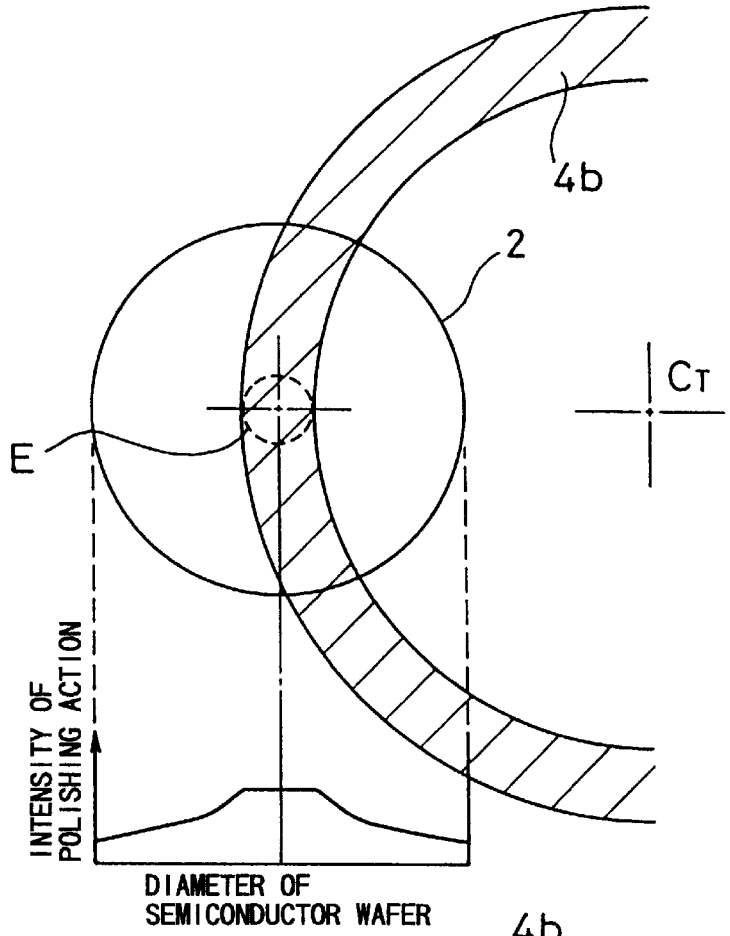
FIGS. 12A and 12B are plan views showing the manner in which the second elastic region shown in FIGS. 11A and 11B operates.
Figure 12B:
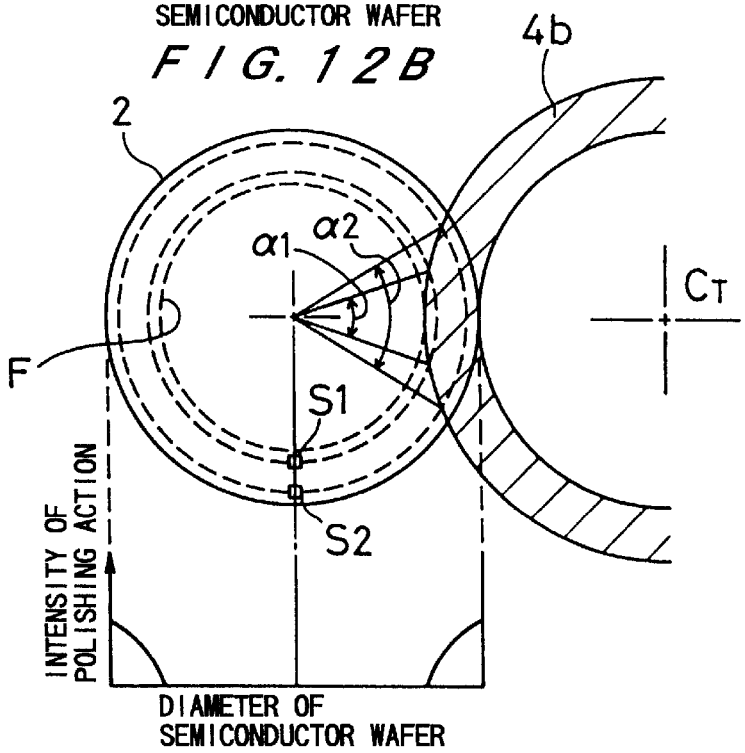

FIGS. 12A and 12B illustrate areas in which the second elastic region 4*b* acts, and FIGS. 12A and 12B correspond to the FIGS. 11A and 11B, respectively. In FIG. 12A, since the second elastic region 4*b* extends through the center of the semiconductor wafer 2 across the outer circumferential edge thereof, the second elastic region 4*b* acts on the entire area of the semiconductor wafer 2 when the semiconductor wafer 2 rotates. A circular area E of the semiconductor wafer 2, which is indicated by the broken line in FIG. 12A, is held in contact with the second elastic region 4*b* at all times. In FIG. 12B, inasmuch as the second elastic region 4*b* contacts only an outer circumferential edge portion of the semiconductor wafer 2, the second elastic region 4*b* does not act in a circular area of the semiconductor wafer 2 within a circle F indicated by the innermost broken line. In the area of the semiconductor wafer 2 which is contacted by the second elastic region 4*b*, the degree to which the semiconductor wafer 2 contacts the second elastic region 4*b* while the semiconductor wafer 2 makes one revolution varies in accordance with the distance from the center of the semiconductor wafer 2 in its surface. Specifically, as shown in FIG. 12B, a small area S1 in an inner circumferential zone of the area of the semiconductor wafer 2 which is held in contact with the second elastic region 4*b* is contacted by the second elastic region 4*b* through an angle $\alpha 1$ during one revolution of the semiconductor wafer 2, whereas a small area S2 in an outer circumferential zone of the area of the semiconductor wafer 2 which is held in contact with the second elastic region 4*b* is contacted by the second elastic region 4*b* through an angle $\alpha 2$ during one revolution of the semiconductor wafer 2. The angle $\alpha 2$ is greater than the angle $\alpha 1$.

Therefore, the area of the semiconductor wafer 2 in which the second elastic region 4*b* acts contains different areas that are contacted by the second elastic region 4*b* to different polishing degrees. The degree to which the second elastic region 4*b* acts on the semiconductor wafer 2 is uniform in the same circumference, but varies radially, of the semiconductor wafer 2. FIGS. 12A and 12B show, in lower graphs thereof, respective distributions of degrees to which the second elastic regions 4*b* shown in FIGS. 11A and 11B act on the semiconductor wafer 2 in the diametrical direction. In each of the graphs, the vertical axis represents the degree to which the second elastic region 4*b* acts on the semiconductor wafer 2, i.e., the intensity of polishing action, and the horizontal axis represents the diameter of the semiconductor wafer 2.

In FIG. 12A, because the center of the semiconductor wafer 2 is contacted by the second elastic region 4*b* at all times, the second elastic region 4*b* acts on the semiconductor wafer 2 to the greatest degree at the center of the semiconductor wafer 2, so that the distribution curve has its peak at its center. In FIG. 12B, the second elastic region 4*b* does not act on the center of the semiconductor wafer 2, but acts on the semiconductor wafer 2 to a greater degree in a radially outward direction, so that the distribution curve has its peak at its opposite ends.

With the configurations shown in FIGS. 11A, 11B and 12A, 12B, the elastic regions 4*b* act on the center and outer circumferential edge, respectively, of the semiconductor wafer 2. However, an annular second elastic region may be positioned so as to extend intermediate between the center and outer circumferential edge portions of the semiconductor wafer 2, or may have a different width. Furthermore, the center of the semiconductor wafer 2 may be spaced from the center of the turntable 1 by a different distance, or a plurality of annular second elastic regions having different diameters may be employed. These modifications may be selected singly or in combination to vary the area of the semiconductor wafer 2 in which the second elastic region or regions 4*b* act or the degree to which the second elastic region or regions 4*b* act on the semiconductor wafer 2.

Figure 13A:
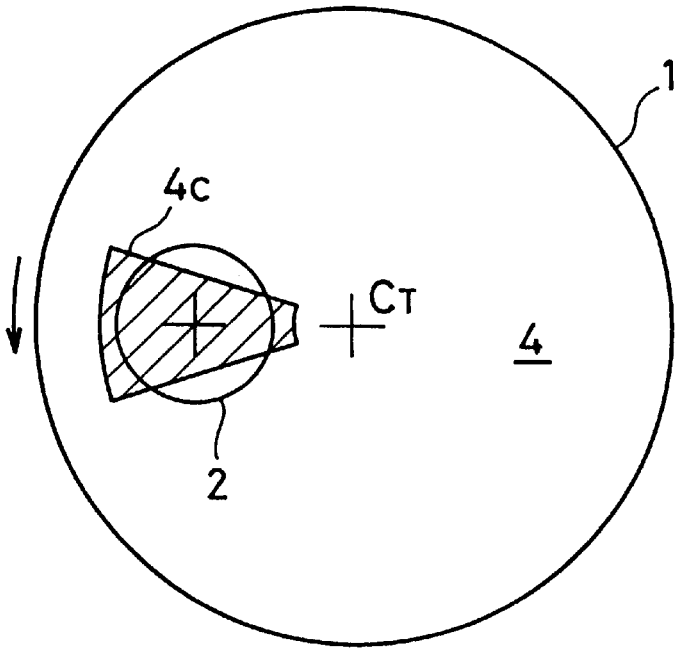
FIGS. 13A and 13B are plan views of a polishing cloth according to another embodiment of the present invention.
Figure 13B:
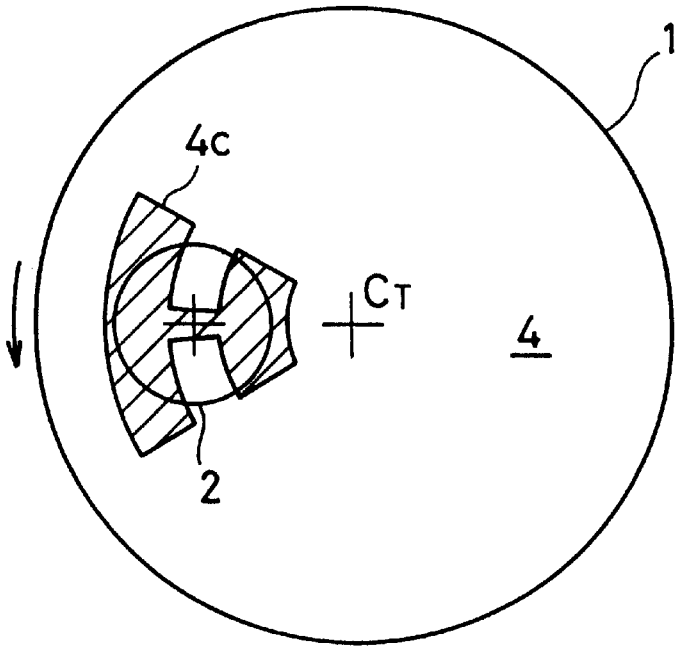

FIGS. 13A and 13B are a plan views of the polishing cloth according to the another embodiment of the present invention. The polishing cloth 4 on the upper surface of the turntable has a substantially trapezoidal elastic region 4*c* having an elastic modulus different from that of the other region which surrounds the trapezoidal elastic region 4*c*. Hereinafter, the elastic region 4*c* is referred to as second elastic region 4*c*, and the other region which surrounds the second elastic region 4*c* is referred to as first elastic region. When the second elastic region 4*c* contacts the semiconductor wafer 2, the contacting area of the second elastic region 4*c* is smaller than that of the semiconductor wafer 2. Thus, since the distribution of the polishing degree to which the second elastic region 4*c* acts on the semiconductor wafer 2 is controlled, it is possible to polish a desired area of the semiconductor wafer more intensively or less intensively.

Figure 14:
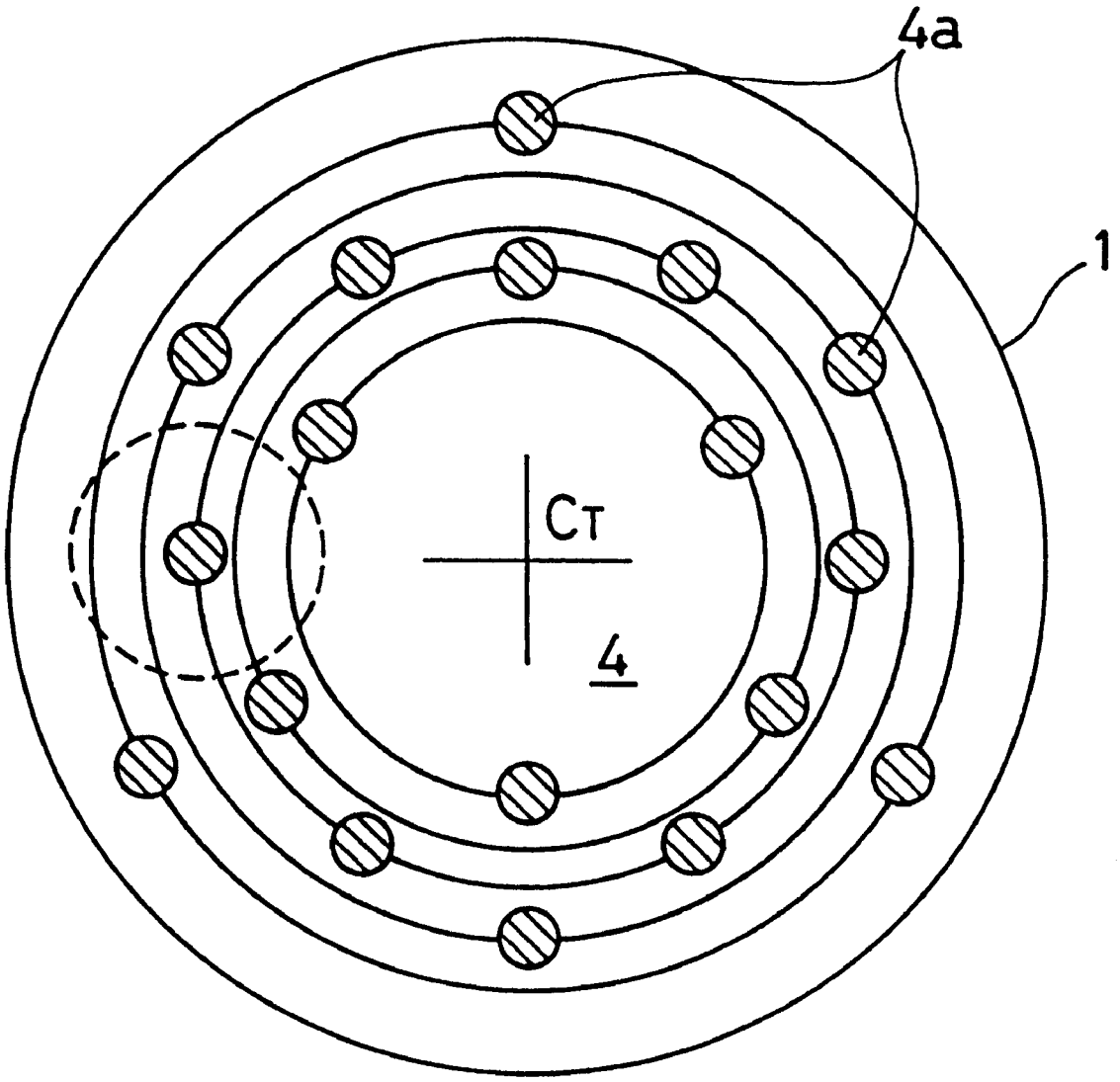
FIG. 14 is a plan view of the polishing cloth on the upper surface of the turntable.
Figure 15:
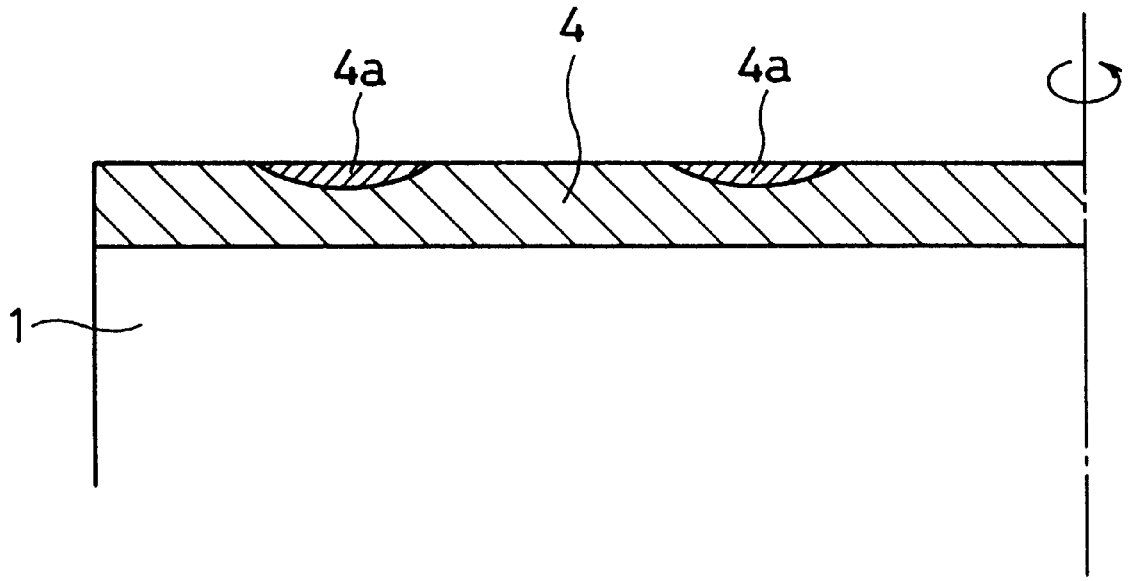
FIG. 15 is a cross-sectional view of the polishing cloth on the upper surface of the turntable.

A specific structure of the different elastic regions of the polishing cloth will be described with reference to FIGS. 14 and 15. FIG. 14 is a plan view of the polishing cloth 4, and FIG. 15 is a fragmentary cross-sectional view of the turntable 1 with the polishing cloth 4. As shown in FIG. 14, the polishing cloth 4 has a plurality of small circular second elastic regions 4*a*, which are formed by a thermosetting process, on five concentric circles of different diameters which are concentric with the center $C_T$ of the turntable 1.

Figure 16:
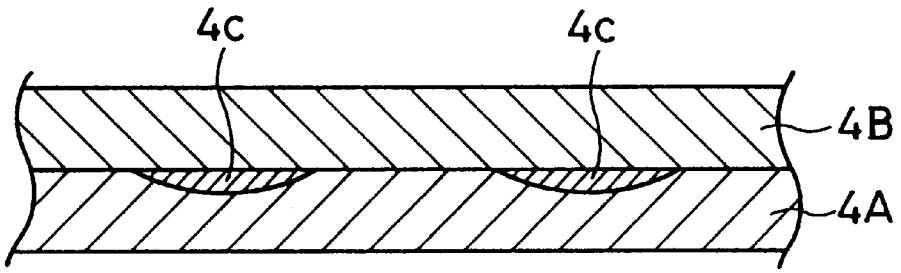
FIG. 16 is an enlarged cross-sectional view of another modified polishing cloth on the upper surface of the turntable.

FIG. 16 is a cross-sectional view of another embodiment of the present invention. The polishing cloth of the present embodiment has a double-layer structure comprising a lower polishing cloth 4A to be attached to the turntable and an upper polishing cloth 4B provided on the lower polishing cloth 4A. On the lower polishing cloth 4A, elastic regions 4*c* having an elastic modulus different from the other region surrounding the elastic regions 4*c* are formed by a thermosetting process. The upper polishing cloth 4B has second elastic regions, at locations corresponding to the elastic regions 4*c*, having an elastic modulus different from that of the other region (first elastic region) which surrounds the second elastic regions.

Figure 17:
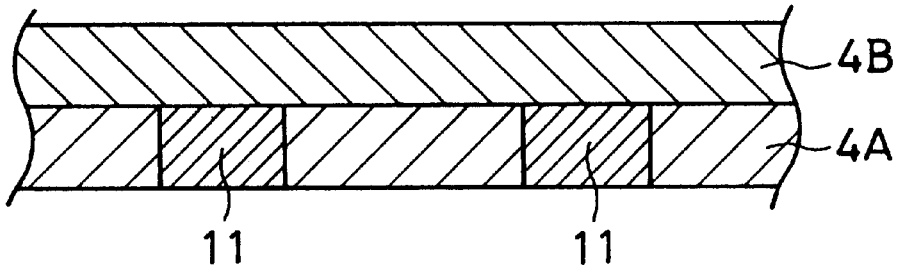
FIG. 17 is an enlarged cross-sectional view of still another modified polishing cloth on the upper surface of the turntable.

FIG. 17 is a cross-sectional view of the polishing cloth of another embodiment of the present invention. The polishing cloth of the present embodiment also has a double-layer structure comprising the lower polishing cloth 4A and the upper polishing cloth 4B, as, the embodiment shown in FIG. 16. However, in this embodiment, elastic materials 11 having an elastic modulus different than the lower polishing cloth 4A are provided in the lower polishing cloth 4A. The elastic materials 11 may comprise urethan resin, polyurethan foam or hard rubber.

According to the polishing clothes shown in FIGS. 16 and 17, since the polishing action is increased on the surface of the semiconductor wafer contacting the second elastic region above the thermosetting region or the region where the elastic material 11 is provided, it is possible to control the polishing action on the semiconductor wafer and polish a desired area of the semiconductor wafer more intensively, as well as the polishing cloth shown in FIG. 15.

It should be noted that the shape, the size or the position of the thermosetting region can be selected freely in consideration of a polished surface produced by the thermosetting region.

Figure 18:
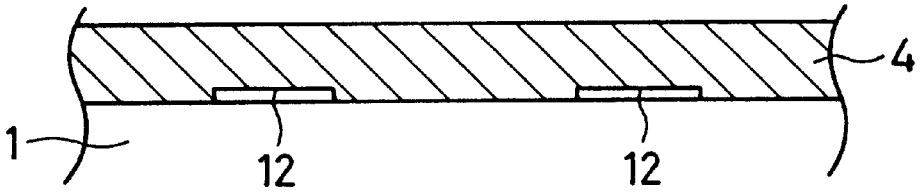
FIG. 18 is an enlarged cross-sectional view of a polishing cloth according to another embodiment of the present invention.

FIG. 18 is a cross-sectional view of another embodiment of the present invention. The polishing cloth 4 of the present embodiment has recesses 12 defined in the lower surface of a substrate. As the recess 12 forms a space toward the turntable 1, the polishing cloth is easily compressed over the recess 12 and a repulsive force from the polishing cloth over the recess 12 is weaker than that of a flat portion of the polishing cloth when the pressing force is applied to the polishing cloth. This means that the polishing action of the polishing cloth over the recess 12 is weaker than the other region of the polishing cloth. Also, a material having an elastic modulus higher or lower than the polishing cloth 4 may be provided in the recess 12.

Figure 19A:
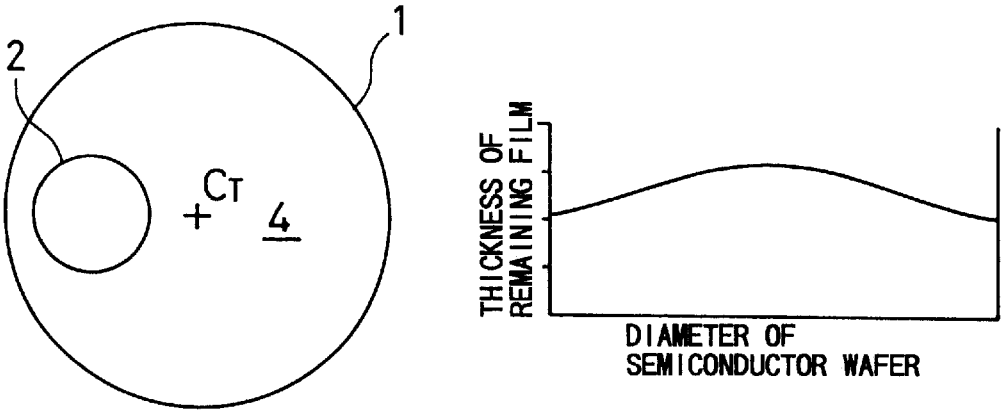
FIGS. 19A, 19B, and 19C are views showing comparisons between the polishing cloth according to the present invention and a conventional polishing cloth.
Figure 19B:
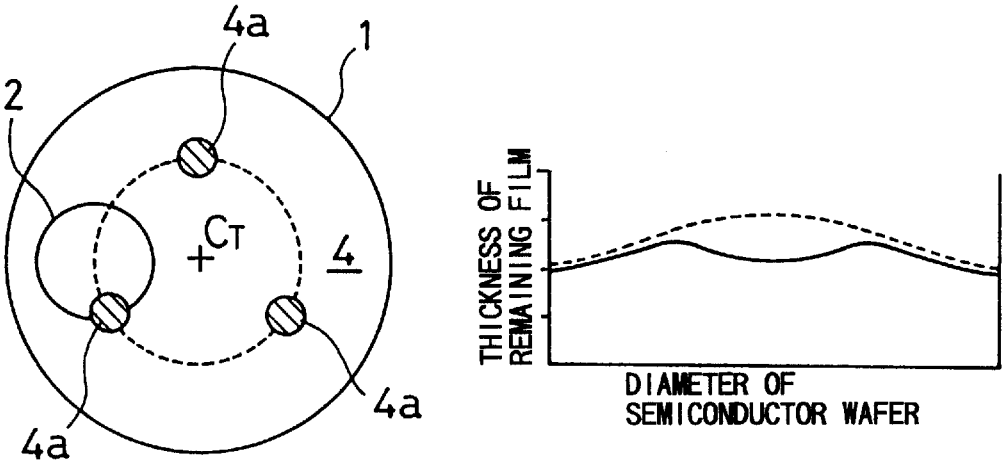
Figure 19C:
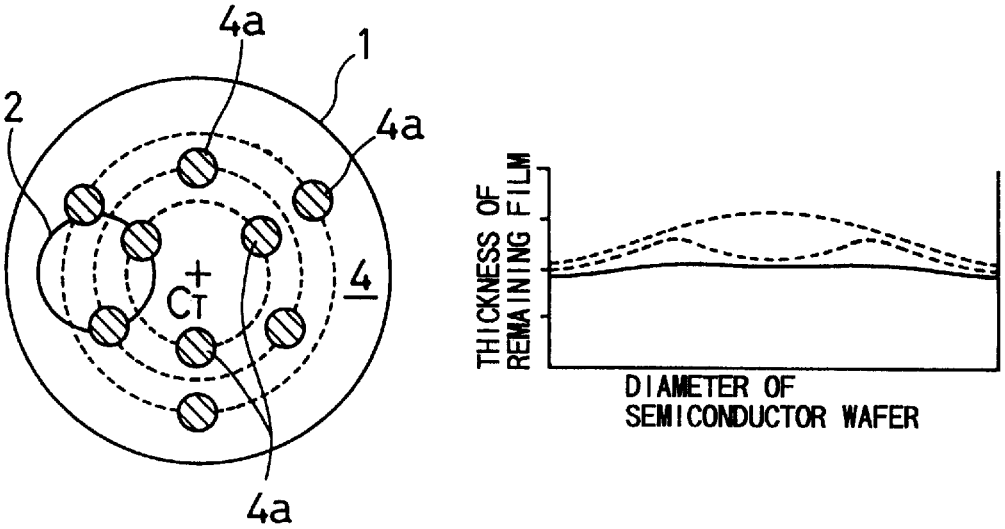

FIGS. 19A, 19B, and 19C show advantages of the polishing apparatus according to the present invention.

FIG. 19A shows the result of a polishing action which was effected, by a conventional polishing apparatus, on a semiconductor wafer 2 which has an insulating film of silicon oxide ($SiO_2$) deposited on a substrate of silicon (Si). FIG. 19A shows a polishing cloth 4 on its left-hand side, and a graph on its right-hand side which indicates the thickness of an insulating film remaining on the substrate after the polishing action. The graph has a vertical axis representing the thickness of the remaining insulating film and a horizontal axis representing the diameter of the semiconductor wafer 2. The polishing cloth was made of polyurethane foam, and the abrasive liquid was of a general composition with silica particles dispersed in an alkaline solution. It can be seen from FIG. 19A that the thickness of the remaining insulating film is large in a central area of the semiconductor wafer and the polished surface of the semiconductor wafer was not flat.

FIG. 19B shows the result of a polishing action effected on the same kind of semiconductor wafer by a polishing apparatus according to the present invention. As shown in FIG. 19B on its left-hand side, the polishing cloth 4 has a circular pattern of elastic regions which form respective second elastic regions 4*a* at such positions as to pass through the center of the semiconductor wafer 2. After the semiconductor wafer 2 was polished, the thickness of the remaining insulating film was reduced in its central area, i.e., the central area of the semiconductor wafer 2 was polished to a greater degree. Thus the flatness of the polished semiconductor wafer 2 was increased as compared with the semiconductor wafer 2 shown in FIG. 19A, as can be understood from a graph on the right-hand side of FIG. 19B.

FIG. 19C shows the result of a polishing action effected on the same kind of semiconductor wafer by another polishing apparatus according to the present invention. As shown in FIG. 19C on its left-hand side, the polishing cloth 4 has concentric circular patterns of elastic regions which form respective second elastic regions 4*a* at such positions as to pass through the center and other intermediate portions of the semiconductor wafer 2. After the semiconductor wafer 2 was polished, the thickness of the remaining insulating film was reduced in its central and intermediate areas, i.e., the central and intermediate areas of the semiconductor wafer 2 were polished to a greater degree. Thus the flatness of the polished semiconductor wafer 2 was increased as compared with the semiconductor wafer 2 shown in FIG. 19B, as can be understood from a graph on the right-hand side of FIG. 19C.

As is apparent from the above description, according to the present invention, a second elastic region having an elastic modulus different from a first elastic region surrounding the second elastic region is provided, the second elastic region produces a different polishing action from that of the first elastic region of the polishing cloth, and the area of the workpiece that is contacted by the second elastic region is polished to a different degree from the other areas contacted by the first elastic region of the polishing cloth.

The second elastic region acts on the semiconductor wafer only during the period of time when it passes over or across the surface of the semiconductor wafer, rather than during the entire period of time when the semiconductor wafer is polished by the polishing cloth. By determining the position of the second elastic region in consideration of the area in which the second elastic region acts on the workpiece, it is possible to polish a desired area of the workpiece more intensively or less intensively. That is, it is possible to control a distribution of the polishing rate of the workpiece, and a desired polished surface of the workpiece can be obtained. If the workpiece is to be polished flatwise, a highly precise flatness of the workpiece can be obtained by determining the second elastic region so as to correct polishing irregularities.

As is apparent from the above discussion, and as would be understood by one skilled in the part, top ring 3 supporting the workpiece does not move in a radical direction relative to turnable 1 during a polishing operation.

Although certain preferred embodiments of the present invention have been shown and described in detail, it should be understood that various changes and modifications may be made therein without departing from the scope of the appended claims.

What is claimed is:

1. A polishing cloth to be mounted on a turntable for contacting and polishing a surface of a workpiece supported by a top ring, said polishing cloth comprising:

a substrate to contact the surface of the workpiece, said substrate having an elastic modulus; and a recess defined in a lower surface of said substrate and having a dimension in a radial direction, when said polishing cloth is mounted on the turntable, that is smaller than a diameter of the workpiece, a position of said recess, when said polishing cloth is mounted on the turntable, being determined on the basis of an area in which said recess acts on the workpiece.

2. A polishing cloth as claimed in claim 1, further comprising an elastic material provided in said recess, said elastic material having an elastic modulus different from said elastic modulus of said substrate.

3. A polishing cloth to be mounted on a turntable for contacting and polishing a surface of a workpiece supported by a top ring that is stationary in a radial direction of the turntable during polishing, said polishing cloth comprising:

a first elastic region to contact the surface of the workpiece, said first elastic region having a first elastic modulus; and at least one second region to contact the surface of the workpiece, said at least one second elastic region having a second elastic modulus different from said first elastic modulus of said first elastic region, each said at least one second elastic region having a dimension in a radial direction, when said polishing cloth is mounted on the turntable, that is smaller than a diameter of the workpiece, and the number of second elastic regions, and a position, size and shape of each said at least one second elastic region, when said polishing cloth is mounted on the turntable, being determined on the basis of an area in which said at least one second elastic region acts on the workpiece.

4. A polishing cloth as claimed in claim 3, wherein each said at least one second elastic region comprises a cured part of said polishing cloth.

5. A polishing cloth as claimed in claim 3, comprising a lower layer, and an upper layer on said lower layer and to contact the surface of the workpiece, each said at least one second elastic region comprising a cured part of said lower layer.

6. A polishing cloth as claimed in claim 3, comprising a lower layer, and an upper layer on said lower layer and to contact the surface of the workpiece, each said at least one second elastic region comprising an elastic material provided in said lower layer, said elastic material having said second elastic modulus different from an elastic modulus of said lower layer.

7. A polishing cloth as claimed in claim 3, wherein said first elastic region surrounds said at least one second elastic region.

8. A polishing cloth to be mounted on a turntable for contacting and polishing a surface of a workpiece supported by a top ring that is stationary in a radial direction of the turntable during polishing, said polishing cloth comprising:

a first elastic region to contact the surface of the workpiece, said first elastic region having a first elastic modulus; and at least one second region to contact the surface of the workpiece, said at least one second elastic region having a second elastic modulus different from said first elastic modulus of said first elastic region, said at least one second elastic region having an area that, when said polishing cloth is mounted on the turntable and said at least one second elastic region is in contact with the surface of the workpiece, is smaller than an area of the workpiece, and the number of second elastic regions, and a position, size and shape of each said at least one second elastic region, when said polishing cloth is mounted on the turntable, being determined on the basis of an area in which said at least one second elastic region acts on the workpiece.

9. A polishing cloth as claimed in claim 8, wherein each said at least one second elastic region comprises a cured part of said polishing cloth.

10. A polishing cloth as claimed in claim 8, comprising a lower layer, and an upper layer on said lower layer and to contact the surface of the workpiece, each said at least one second elastic region comprising a cured part of said lower layer.

11. A polishing cloth as claimed in claim 8, comprising a lower layer, and an upper layer on said lower layer and to contact the surface of the workpiece, each said at least one second elastic region comprising an elastic material provided in said lower layer, said elastic material having said second elastic modulus different from an elastic modulus of said lower layer.

12. A polishing cloth as claimed in claim 8, wherein said first elastic region surrounds said at least one second elastic region.

13. A polishing cloth to be mounted on a turntable for contacting and polishing a surface of a workpiece supported by a top ring that is stationary in a radial direction of the turntable during polishing, said polishing cloth comprising:

a first elastic region to contact the surface of the workpiece, said first elastic region having a first elastic modulus, whereby when said first elastic region contacts the surface of the workpiece during a polishing operation at least one area of the surface tends to be polished less intensively at a lower polishing rate than at least one other area of the surface, thus tending to create polishing irregularities on the surface; and a second elastic region to contact the surface of the workpiece, said second elastic region having a second elastic modulus different from said first elastic modulus of said first elastic region, said second elastic region having a dimension in a radial direction, when said polishing cloth is mounted on the turntable, that is smaller than a diameter of the workpiece, said second elastic region having a property to polish the surface of the workpiece at a polishing rate higher than said lower polishing rate, thereby to correct the polishing irregularities, and a position, size and shape of said second elastic region, when said polishing cloth is mounted on the turntable, being determined on the basis of an area in which said second elastic region acts on the workpiece.

14. A polishing cloth to be mounted on a turntable for contacting and polishing a surface of a workpiece supported by a top ring that is stationary in a radial direction of the turntable during polishing, said polishing cloth comprising:

a first elastic region to contact the surface of the workpiece, said first elastic region having a first elastic modulus, whereby when said first elastic region contacts the surface of the workpiece during a polishing operation at least one area of the surface tends to be polished less intensively at a lower polishing rate than at least one other area of the surface, thus tending to create polishing irregularities on the surface; and a second elastic region to contact the surface of the workpiece, said second elastic region having a second elastic modulus different from said first elastic modulus of said first elastic region, said second elastic region having an area, when said polishing cloth is mounted on the turntable, that is smaller than an area of the workpiece, said second elastic region having a property to polish the surface of the workpiece at a polishing rate higher than said lower polishing rate, thereby to correct the polishing irregularities, and a position, size and shape of said second elastic region, when said polishing cloth is mounted on the turntable, being determined on the basis of an area in which said second elastic region acts on the workpiece.

15. A polishing apparatus comprising:

a turntable having an upper surface;

a polishing cloth mounted on said upper surface;

a top ring positioned above said turntable for supporting a workpiece to be polished and pressing the workpiece against said polishing cloth, said top ring being stationary in a radial direction of said turntable during a polishing operation;

said polishing cloth comprising:

a first elastic region to contact the surface of the workpiece, said first elastic region having a first elastic modulus; and a second region to contact the surface of the workpiece, said second elastic region having a second elastic modulus different from said first elastic modulus of said first elastic region, said second elastic region having a dimension in a radial direction that is smaller than a diameter of the workpiece, and a position, size and shape of said second elastic region being determined on the basis of an area in which said second elastic region acts on the workpiece.

16. A polishing apparatus comprising:

a turntable having an upper surface;

a polishing cloth mounted on said upper surface;

a top ring positioned above said turntable for supporting a workpiece to be polished and pressing the workpiece against said polishing cloth;

said polishing cloth comprising:

a substrate to contact the surface of the workpiece, said substrate having an elastic modulus; and a recess defined in a lower surface of said substrate and having a dimension in a radial direction that is smaller than a diameter of the workpiece, a position of said recess being determined on the basis of an area in which said recess acts on the workpiece.

* * * * *